US012060527B2

(12) United States Patent
Sattler et al.

(10) Patent No.: US 12,060,527 B2
(45) Date of Patent: Aug. 13, 2024

(54) CO-PROCESSING OF PYROLYSIS OILS, LUBRICANTS, AND/OR PLASTICS

(71) Applicant: EXXONMOBIL TECHNOLOGY AND ENGINEERING COMPANY, Annandale, NJ (US)

(72) Inventors: Aaron Sattler, Annandale, NJ (US); Hyung Rae Kim, Annandale, NJ (US); Theodore W. Walker, Annandale, NJ (US); Ethan G. Dacosta, Annandale, NJ (US); Xiaochun Xu, Annandale, NJ (US)

(73) Assignee: ExxonMobil Technology and Engineering Company, Annandale, NJ (US)

( * ) Notice: Subject to any disclaimer, the term of this patent is extended or adjusted under 35 U.S.C. 154(b) by 0 days.

(21) Appl. No.: 18/166,852

(22) Filed: Feb. 9, 2023

(65) Prior Publication Data

US 2023/0257664 A1 Aug. 17, 2023

Related U.S. Application Data

(60) Provisional application No. 63/310,641, filed on Feb. 16, 2022.

(51) Int. Cl.

| | |
|---|---|
| ***C10G 1/00*** | (2006.01) |
| ***C10G 3/00*** | (2006.01) |
| ***C10G 11/18*** | (2006.01) |

(52) U.S. Cl.

CPC .... *C10G 11/182* (2013.01); *C10G 2300/1003* (2013.01); *C10G 2300/1007* (2013.01);

(Continued)

(58) Field of Classification Search

CPC ..... C10G 11/182; C10G 2300/1003; C10G 2300/1007; C10G 2300/1011; C10G 2300/1074

See application file for complete search history.

(56) References Cited

U.S. PATENT DOCUMENTS

| | | | | |
|---|---|---|---|---|
| 9,040,761 | B2 * | 5/2015 | Bartek | C10G 3/42 585/240 |
| 2013/0276360 | A1 * | 10/2013 | Boon | C10G 3/42 44/307 |
| 2023/0085274 | A1 * | 3/2023 | Liu | C10G 1/002 |

FOREIGN PATENT DOCUMENTS

| | | |
|---|---|---|
| EP | 3 950 889 A1 | 2/2022 |
| WO | 2011/103026 A1 | 8/2011 |

OTHER PUBLICATIONS

Pinho, A., D., R., et al., "Fast pyrolysis oil from pinewood chips co-processing with vacuum gas oil in an FCC unit for second generation fuel production", Fuel, IPC Sience and Technology Press, vol. 188, pp. 462-473 (Oct. 15, 2016).

(Continued)

*Primary Examiner* — In Suk C Bullock
*Assistant Examiner* — Jason Y Chong
(74) *Attorney, Agent, or Firm* — Shook, Hardy & Bacon L.L.P.

(57) ABSTRACT

The present disclosure provides methods and systems for co-processing a hydrocarbon feed in an FCC system with a second feed of a biomass-derived pyrolysis oil and a third feed of a plastic-derived pyrolysis oil and/or lubricant. A method of co-processing fluid catalytic cracking feeds, includes: introducing a hydrocarbon feed to a fluid catalytic cracking reactor, wherein the hydrocarbon feed comprises hydrocarbons; introducing a biomass feed to the fluid catalytic cracking reactor wherein the biomass feed comprises a biomass-derived pyrolysis oil; introducing a waste feed to (Continued)

the fluid catalytic cracking reactor, wherein the waste feed comprises a plastic, a plastic-derived pyrolysis oil, a lubricant, or a combination thereof; and reacting at least the hydrocarbon feed, the biomass feed, and the waste feed in the presence of one or more fluid catalytic cracking catalysts in the fluid catalytic cracking reactor to produce cracked products.

19 Claims, 4 Drawing Sheets

(52) U.S. Cl.
CPC ..... *C10G 2300/1011* (2013.01); *C10G 2300/1074* (2013.01)

(56) References Cited

OTHER PUBLICATIONS

International Search Report and Written Opinion received for PCT Patent Application No. PCT/US2023/062297, mailed on Apr. 26, 2023, 11 pages.

* cited by examiner

CO-PROCESSING OF PYROLYSIS OILS, LUBRICANTS, AND/OR PLASTICS

CROSS-REFERENCE TO RELATED APPLICATIONS

This Non-Provisional Patent Application Claims Priority To U.S. Provisional Patent App. No. 63/310,641, Filed Feb. 16, 2022, And Titled "CO-PROCESSING OF PYROLYSIS OILS, LUBRICANTS, AND/OR PLASTICS," The Entire Contents Of Which Is Incorporated Herein By Reference.

FIELD

This application relates to co-processing of feeds in a fluid catalytic cracking system and, more particularly, one or more embodiments relate to the co-processing in a fluid catalyst cracking system of a hydrocarbon feed with a biomass-derived pyrolysis oil and a hydrogen-containing waste feed, such as a plastic, a plastic-derived pyrolysis oil and/or a lubricant.

BACKGROUND

Cracking of hydrocarbons is a process that is widely used to break down larger and higher boiling hydrocarbons into smaller and lower boiling hydrocarbons that can be more valuable. Fluid catalytic cracking (FCC) is one technique for hydrocarbon cracking that uses catalyst and heat to break down larger and higher boiling hydrocarbons into smaller and lower boiling hydrocarbons, such as naphtha, gasoline, distillate, and other petroleum products. Typically, the feedstock for FCC is a heavy gas oil with the heavy gas oil heated then placed into contact with a catalyst that breaks apart the larger hydrocarbons into smaller molecules. Conventional FCC, however, can be sensitive to alternative feedstocks. For example, co-feeding alternative feedstocks into an FCC system can result in undesirable conversion rates. It would be desirable, however, to have improved processes and systems for processing alternative feedstocks in FCC systems.

SUMMARY

Disclosed herein is an example method of co-processing fluid catalytic cracking feeds, including: introducing a hydrocarbon feed to a fluid catalytic cracking reactor, wherein the hydrocarbon feed includes hydrocarbons; introducing a biomass feed to the fluid catalytic cracking reactor wherein the biomass feed includes a biomass-derived pyrolysis oil; introducing a waste feed to the fluid catalytic cracking reactor, wherein the waste feed includes a plastic, a plastic-derived pyrolysis oil, a lubricant, or a combination thereof; and reacting at least the hydrocarbon feed, the biomass feed, and the waste feed in the presence of one or more fluid catalytic cracking catalysts in the fluid catalytic cracking reactor to produce cracked products.

Further disclosed herein is an example system for cracking hydrocarbons, including a first source of a hydrocarbon feed including hydrocarbons; a second source of a biomass feed including a biomass-derived pyrolysis oil; a third source of a waste feed including a plastic, a plastic-derived pyrolysis oil, a lubricant, or a combination thereof; and a fluid catalytic cracking system including a fluid catalytic cracking reactor and a catalyst regenerator, wherein the fluid catalytic cracking reactor is fluidically coupled to the catalyst regenerator such the fluid catalytic cracking reactor receives regenerated catalyst from the catalyst regenerator, wherein the fluid catalytic cracking reactor is fluidically coupled to the first source of the hydrocarbon feed; wherein the fluid catalytic cracking reactor is fluidically coupled to the second source of the biomass feed; and wherein the fluid catalytic cracking reactor is fluidically coupled to the third source of the waste feed.

These and other features and attributes of the disclosed methods and systems of the present disclosure and their advantageous applications and/or uses will be apparent from the detailed description which follows.

BRIEF DESCRIPTION OF THE DRAWINGS

To assist those of ordinary skill in the relevant art in making and using the subject matter hereof, reference is made to the appended drawings, wherein.

DETAILED DESCRIPTION

Figure 1:
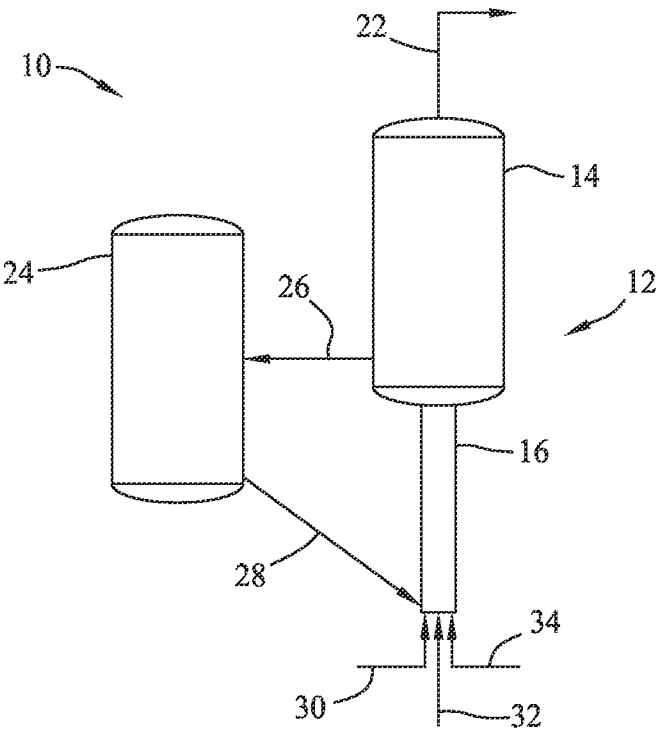
FIG. 1 is an illustrative depiction of a fluid catalytic cracking (FCC) system for processing a hydrocarbon feed with one or more alternative feedstocks in accordance with certain embodiments of the present disclosure.

This application relates to methods and systems for co-processing a hydrocarbon feed in a fluid catalytic cracking (FCC) system with a biomass feed of a biomass-derived ("BD") pyrolysis oil and a waste feed, such as a plastic, a plastic-derived ("PD") pyrolysis oil and/or a lubricant. Advantageously, the co-processing of hydrocarbon feeds with renewable feeds, such as a BD pyrolysis oil, PD pyrolysis oil, and/or plastic results in the production of renewable fuels with reduced carbon intensity, including renewable gasoline and renewable diesel, among others. Moreover, example embodiments co-feed lubricant as the waste feed thus providing for an effective means of recycling waste lubricants that would otherwise require disposal. Even Zfurther, co-processing a hydrocarbon feed with a co-feed of a BD pyrolysis oil and the hydrogen-containing waste feed (e.g., at least one of plastic, PD pyrolysis oil, or lubricant) has been observed to provide higher conversions with the same reactor severity than for processing of the hydrocarbon feed alone, thus indicating a synergistic effect of the co-feeds. Even further, a BD pyrolysis oil is typically hydrogen deficient, with lower hydrogen-to-carbon ("H/C") ratios while the hydrogen-containing waste feeds are hydrogen proficient, with higher H/C ratios, which makes the three feed system synergistic and beneficial.

FCC System Feeds

Example embodiments include processing of a hydrocarbon feed including hydrocarbons in an FCC system. The hydrocarbon feed includes any of a variety of suitable hydrocarbons that can be processed in an FCC system.

Examples of suitable hydrocarbon feeds include whole and reduced petroleum crudes, atmospheric and vacuum residue, propane deasphalted residue, e.g., brightstock, cycle oils, fluid catalytic tower bottoms, gas oils, including atmospheric and vacuum gas oils and coker gas oils, light to heavy distillates including raw virgin distillates, hydrocrackates, hydrotreated oils, dewaxed oils, slack waxes, Fischer-Tropsch waxes, raffinates, and mixtures of these materials. In some embodiments, the hydrocarbon feed includes vacuum gas oils boiling up to 1100° F. (593° C.), including vacuum gas oils boiling in the range of 660° F. to 935° F. (350° C. to 500° C.), as determined in accordance with ASTM D2887, titled "Standard Test Method for Boiling Range Distribution of Petroleum Fractions by Gas Chromatograph." The hydrocarbon feed is fed to the FCC system at any suitable concentration, including in an amount of 50% or more by weight of a combined feed of the hydrocarbon feed, biomass feed, and waste feed. In some embodiments, the hydrocarbon feed is fed to the FCC system at any suitable concentration, including in an amount of 50 wt. % or more of a combined feed. For example, the hydrocarbon feed is fed to the FCC system at concentrations of 50 wt. % to 95 wt. %, 60 wt. % to 95 wt. %, 70 wt. % to 95 wt. %, 75 wt. % to 95 wt. %, 80 wt. % to 95 wt. %, 50 wt. % to 90 wt. %, 50 wt. % to 80 wt. %, 50 wt. % to 70 wt. %, 50 wt. % to 60 wt. %, 60 wt. % to 90 wt. %, 70 wt. % to 90 wt. %, 80 wt. % to 90 wt. %, 70 wt. % to 85 wt. %, or 75 wt. % to 85 wt. % of the combined feed, or any ranges therebetween.

As previously described, the hydrocarbon feed including hydrocarbons is co-fed to the FCC system with a biomass feed including BD pyrolysis oil and a waste feed including plastic, a PD pyrolysis oil and/or lubricant in an FCC, in accordance with present embodiments. These co-feeds synergistically provided increased conversion than from feeding the hydrocarbon feed of hydrocarbons alone. For example, the two co-feeds increased product conversion by 5% or more, including by 5% to 20% or 5% to 10% on a hydrocarbon basis as compared to feeding of only the hydrocarbon feed at the same reactor severity. In addition, the combination of the two co-feeds has also been shown to synergistically improve product conversions as opposed to separate co-feed of either the biomass feed or waste feed with the hydrocarbon feed. For example, the two co-feeds increased product conversion by 3% or more, including by 5% to 10% on a hydrocarbon basis as compared to feeding of only the hydrocarbon feed with either the biomass or waste feed at the same reactor severity. Even further, the co-feeds are compatible with another providing similar product yields. Thus, co-processing of the hydrocarbon, biomass, and waste feeds can make the same cracked products with advantaged feeds, such as biofeeds (BD pyrolysis oil) and waste feeds (e.g., plastics, PD pyrolysis oil and/or lubricant). Accordingly, the bio content of the cracked products provides renewable credits for the cracked products, including tradeable credits called Renewable Identification Numbers ("RINs") under the Energy Independent and Security Act of 2007.

The second co-feed includes BD pyrolysis oil in accordance with one or more embodiments. Pyrolysis is a technique of chemical recycling that includes thermal degradation of the waste to produce gas and liquid products, referred to as pyrolysis oil and a pyrolysis gas. As used herein "biomass-derived pyrolysis oil" or "BD pyrolysis oil" refers to compositions of matter that are liquid when measured at 25° C. and 1 atm, and at least a portion of which are obtained from a biofeed. In some embodiments, the pyrolysis includes treatment of the biomass at high temperatures and short contact times to form a fast pyrolysis oil. For example, fast pyrolysis for forming the fast pyrolysis oil includes heating of the biomass to high temperatures of 400° C. to 600° C. for short residence times typically less than 3 seconds.

The biomass can include any organic source of energy or chemicals that is renewable. Examples of suitable bio biomass include any naturally occurring macromolecules, including, without limitation, lignocellulosic biomass, celluloses, hemicelluloses, polysaccharides, pectins, lignins, chitins, proteins, algae, and combinations thereof. Some non-limiting examples of suitable biomass include, but are not limited to, plant biomass, wood biomass, wood pulp, sawdust, paper products, agricultural products, agricultural trimmings, agricultural residues, crops, food waste, bamboo, bagasse, sugarcane, cotton stalks, corn stalks, Jathropha trimmings, palm plants, coconut shells, municipal waste which includes lignin and/or food waste, cardboard, algae bodies soy oil, canola oil, camelina oil, olive oil, macadamia oil, sunflower oil, rapeseed (canola) oil, soybean oil, sunflower oil, palm oil, palm kernel oil, peanut oil, linseed oil, tall oil, corn oil, castor oil, jatropha oil, jojoba oil, olive oil, flaxseed oil, camelina oil, safflower oil, babassu oil, rice bran oil, algae oil, and combinations thereof.

The particular composition and properties of the BD pyrolysis oil will vary based on a number of factors, including the pyrolysis conditions, the pyrolysis technique, and the initial biomass used. In some embodiments, the BD pyrolysis oil includes oxygenates, such as alcohols, ketones, furans and phenols. In addition, example embodiments of BD pyrolysis oil also include nitrogen and/or sulfur compounds. In some embodiments, the BD pyrolysis oil may be considered an oxygenated hydropyrolysis oil. Oxygenated pyrolysis oil includes pyrolysis oils which include 10 wt. % to 60 wt. % of the oxygen present in the original biomass as oxygenate components. Alternatively, from 10 wt. % to 20 wt. %, 20 wt. % to 30 wt. %, 30 wt. % to 40 wt. %, 40 wt. % to 50 wt. %, 50 wt. % to 60 wt. %, or any ranges therebetween. In some embodiments, the BD pyrolysis oil produced by the present process can be co-processed in the FCC without further treatment to remove the oxygenates.

In some embodiments, the BD pyrolysis oil has any suitable API gravity as desired for a particular application. As used herein, the term "API gravity" is a measure of how heavy or light an oil is as compared to water as measured in accordance with ASTM D4052. In some embodiments, the BD pyrolysis oil has an API gravity of 0 to 40, including an API gravity from 0 to 10, from 10 to 20, from 20 to 30, from 30 to 40, or any ranges therebetween.

In some embodiments, the BD pyrolysis oil has a final boiling point of 600° C. or less. As used herein, the final boiling point is the temperature at which the highest boiling point compounds evaporate as determined in accordance with ASTM 2887. In some embodiments, the BD pyrolysis oil has a final boiling point of 400° C. to 600° C., 450° C. to 600° C., 500° C. to 600° C., 550° ° C. to 600° C., 400° C. to 550° C., 450° C. to 550° C., 450° C. to 500° C., or 500° C. to 550° C.

In some embodiments, the BD pyrolysis oil has a kinematic viscosity at 40° C. ("KV40") of 10 centistokes (cSt) or less. As used herein, the terms "kinematic viscosity at 40° C." or "KV40" of an oil refers to the kinematic viscosity at 40° C. as measured in accordance with ASTM D445.

The biomass feed including the BD pyrolysis oil is fed to the FCC system at any suitable concentration, including of 0.1 wt. % to 49.9 wt. % of a combined feed of the hydrocarbon feed, biomass feed, and waste feed. For example, the biomass feed is fed to the FCC system at concentrations of 0.1 wt. % to 40 wt. %, 0.1 wt. % to 30 wt. %, 0.1 wt. % to 20 wt. %, 0.1 wt. % to 10 wt. %, 1 wt. % to 50 wt. %, 1 wt. % to 40 wt. %, 1 wt. % to 30 wt. %, 1 wt. % to 20 wt. %, 1 wt. % to 10 wt. %, 1 wt. % to 5 wt. % of the combined feed, or any ranges therebetween.

An additional co-feed to the FCC system is the waste feed of the plastic, PD pyrolysis oil and/or lubricant in accordance with one or more embodiments. In some embodiments, the waste feed is considered hydrogen proficient because it has a greater hydrocarbon-to-carbon ratio than the BD pyrolysis oil, for example, a hydrogen-to-carbon ratio of 1.9 or more. The waste feed is fed to the FCC system at any suitable concentration, including of 0.1 wt. % to 49.9 wt. % of a combined feed of the hydrocarbon feed, biomass feed, and waste feed. For example, the waste feed is fed to the FCC system at concentrations of 0.1 wt. % to 40 wt. %, 0.1 wt. % to 30 wt. %, 0.1 wt. % to 30 wt. %, 0.1 wt. % to 20 wt. %, 0.1 wt. % to 10 wt. %, 1 wt. % to 50 wt. %, 1 wt. % to 40 wt. %, 1 wt. % to 30 wt. %, 1 wt. % to 20 wt. %, 1 wt. % to 10 wt. %, or 1 wt. % to 5 wt. % of the combined feed, or any ranges therebetween.

In some embodiments, the waste feed includes plastic. Examples of suitable plastics include polyethylene terephthalates (PET or PETE), high density polyethylene (HDPE), low density polyethylene (LDPE), linear low-density polyethylene (LLDPE), polypropylene (PP), polystyrene (PS), and combinations thereof. In some embodiments, the plastic includes plastic waste obtained from any source including, but not limited to, municipal, industrial, commercial or consumer sources. In some embodiments, the plastic includes post-consumer use plastics. Further examples of suitable plastics include plastic waste obtained from a common source or from mixed sources, including mixed plastic waste obtained from municipal or regional sources and/or from waste streams of polyethylene terephthalates (PET), high density polyethylene (HDPE), low density polyethylene (LDPE), linear low-density polyethylene (LLDPE), polypropylene (PP), and/or polystyrene (PS). Even further, examples of suitable plastic include any of various used polymeric articles without limitation. Some examples of the many types of polymeric articles include: films (including cast, blown, and otherwise), sheets, fibers, woven and non-woven fabrics, furniture (e.g., garden furniture), sporting equipment, bottles, food and/or liquid storage containers, transparent and semi-transparent articles, toys, tubing and pipes, sheets, packaging, bags, sacks, coatings, caps, closures, crates, pallets, cups, non-food containers, pails, insulation, and/or medical devices. Further examples include automotive, aviation, boat and/or watercraft components (e.g., bumpers, grills, trim parts, dashboards, instrument panels and the like), wire and cable jacketing, agricultural films, geomembranes, playground equipment, and other such articles, whether blow molded, roto-molded, injection-molded, or the like. The ordinarily skilled artisan will appreciate that such polymeric articles may be made from any of various polymer and/or non-polymer materials, and that the polymer materials may vary widely (e.g., ethylene-based, propylene-based, butyl-based polymers, and/or polymers based on any $C_2$ to $C_{40}$ or even higher olefins, and further including polymers based on any one or more types of monomers, e.g., $C_2$ to $C_{40}$ α-olefin, di-olefin, cyclic olefin, etc. monomers). Common examples include ethylene, propylene, butylene, pentene, hexene, heptene, octene, and styrene; as well as multi-olefinic (including cyclic olefin) monomers such as ethylidene norbornene (ENB) and vinylidene norbornene (VNB) (including, e.g., when such cyclic olefins are used as comonomers, e.g., with ethylene monomers).

In some embodiments, the plastic includes one or more plastics classified as plastic identification code (PIC) 1 to 7 by the Society of the Plastics Industry. For example, the examples of suitable plastics include one or more of the following plastics: polyethylene terephthalate classified as PIC 1; high-density polyethylene classified as PIC 2; polyvinyl chloride classified as PIC 3; low-density polyethylene classified as PIC 4; polypropylene classified as PIC 5; polystyrene classified as PIC 6; and polycarbonate and other plastics classified as PIC 7. Combinations of the various plastics classified as PIC 1 to 7 are also suitable in accordance with present embodiments.

In addition to polymers, a plastic, such as a plastic waste feedstock can include a variety of other components. Such other components can include additives, modifiers, packaging dyes, and/or other components typically added to a polymer during and/or after formulation. The feedstock can further include any components typically found in plastic waste. Finally, the feedstock can further include one or more solvents or carriers so that the feedstock to the coking process corresponds to a solution or slurry of the plastic waste. In various aspects, the plastic waste can be prepared for mixing with the coker feedstock and/or delivery into the coker reactor. Methods for preparing the plastic waste can include reducing the particle size of the polymers and mixing the polymers with a solvent or carrier. Another option can be to melt the plastic waste and then extrude and/or pump it to mix it with a solvent or carrier.

In embodiments where the plastic waste is introduced into the FCC system at least partially as solids, having a small particle size can facilitate transport of the solids and/or reduce the likelihood of incomplete conversion. To prepare solid plastics for an FCC environment, a physical processing step can be performed. Examples of physical processing can include crushing, chopping, shredding, pelletizing (optionally after melting), and grinding (including cryogenic grinding). In some embodiments, the physical processing can be used to reduce the median particle size to 0.01 mm to 5.0 mm, or 0.1 mm to 5.0 mm, or 0.01 mm to 3.0 mm, or 0.1 mm to 3.0 mm, or 0.01 mm to 3.0 mm, or 0.1 mm to 3.0 mm, or 1.0 mm to 5.0 mm, or 1.0 mm to 3.0 mm. to reduce the maximum particle size. For determining a median particle size, the particle size is defined as the diameter of the smallest bounding sphere that contains the particle. Optionally, after the physical processing, the plastic can be sieved or filtered to remove larger particles. Additionally or alternately, the plastic can be melted and pelletized to improve the uniformity of the particle size of the plastic particles. In some aspects, the sieving or filtering can be used to reduce the maximum particle size to 10 mm or less, or 5.0 mm or less.

Additionally or alternately, a solvent can be added to the plastic. For introduction into an FCC system, it can be convenient for the plastic to be in the form of a solution, slurry, or other fluid-type phase. If a solvent is used to at least partially solvate the plastic, any convenient solvent can be used. Examples of suitable solvents can include (but are not limited to) a wide range of petroleum or petrochemical products. For example, some suitable solvents include crude oil, naphtha, kerosene, diesel, light or heavy cycle oils, catalytic slurry oil, and gas-oils. Other potential solvents can correspond to naphthenic and/or aromatics solvents, such as toluene, benzene, methylnaphthalene, cyclohexane, methylcyclohexane, and mineral oil. Still other solvents can correspond to refinery fractions, such as a gas oil fraction or naphtha fraction from a coker. As yet another example, a distillate and/or gas oil boiling range fraction can be used that generated by coking of the combined feed (i.e., combined plastic waste feedstock and coker feedstock).

In some embodiments, the additional co-feed includes PD pyrolysis oil. As used herein, the phrase "PD pyrolysis oil" refers to compositions of matter that are liquid when measured at 25° C. and 1 atm, and at least a portion of which are obtained from the pyrolysis of plastic. Examples of suitable plastics for pyrolysis include polyethylene terephthalates (PET or PETE), high density polyethylene (HDPE), low density polyethylene (LDPE), linear low-density polyethylene (LLDPE), polypropylene (PP), polystyrene (PS), and combinations thereof. In some embodiments, the plastic for pyrolysis includes plastic waste obtained from any source including, but not limited to, municipal, industrial, commercial or consumer sources. In some embodiments, the plastic for pyrolysis includes post-consumer use plastics. Further examples of suitable plastics for pyrolysis include plastic waste obtained from a common source or from mixed sources, including mixed plastic waste obtained from municipal or regional sources and/or from waste streams of polyethylene terephthalates (PET), high density polyethylene (HDPE), low density polyethylene (LDPE), linear low-density polyethylene (LLDPE), polypropylene (PP), and/or polystyrene (PS). Even further, examples of suitable plastic include any of various used polymeric articles without limitation. Some examples of the many types of polymeric articles include: films (including cast, blown, and otherwise), sheets, fibers, woven and nonwoven fabrics, furniture (e.g., garden furniture), sporting equipment, bottles, food and/or liquid storage containers, transparent and semi-transparent articles, toys, tubing and pipes, sheets, packaging, bags, sacks, coatings, caps, closures, crates, pallets, cups, non-food containers, pails, insulation, and/or medical devices. Further examples include automotive, aviation, boat and/or watercraft components (e.g., bumpers, grills, trim parts, dashboards, instrument panels and the like), wire and cable jacketing, agricultural films, geomembranes, playground equipment, and other such articles, whether blow molded, roto-molded, injection-molded, or the like. The ordinarily skilled artisan will appreciate that such polymeric articles may be made from any of various polymer and/or non-polymer materials, and that the polymer materials may vary widely (e.g., ethylene-based, propylene-based, butyl-based polymers, and/or polymers based on any $C_2$ to $C_{40}$ or even higher olefins, and further including polymers based on any one or more types of monomers, e.g., $C_2$ to $C_{40}$ α-olefin, di-olefin, cyclic olefin, etc. monomers). Common examples include ethylene, propylene, butylene, pentene, hexene, heptene, octene, and styrene; as well as multi-olefinic (including cyclic olefin) monomers such as ethylidene norbornene (ENB) and vinylidene norbornene (VNB) (including, e.g., when such cyclic olefins are used as comonomers, e.g., with ethylene monomers).

In some embodiments, the plastic for pyrolysis includes one or more plastics classified as plastic identification code (PIC) 1 to 7 by the Society of the Plastics Industry. For example, the examples of suitable plastics include one or more of the following plastics: polyethylene terephthalate classified as PIC 1; high-density polyethylene classified as PIC 2; polyvinyl chloride classified as PIC 3; low-density polyethylene classified as PIC 4; polypropylene classified as PIC 5; polystyrene classified as PIC 6; and polycarbonate and other plastics classified as PIC 7. Combinations of the various plastics classified as PIC 1 to 7 are also suitable in accordance with present embodiments.

The particular composition and properties of the PD pyrolysis oil will vary based on a number of factors, including the pyrolysis conditions, the pyrolysis technique, and the initial plastic used. In some embodiments, the PD pyrolysis oil includes hydrocarbons, such as paraffins, aromatics, naphthalenes, and olefins. Examples of the PD pyrolysis oil also include contaminants, such as nitrogen and chlorides, among others. In some embodiments, the PD pyrolysis oil includes 90 wt. % or greater of hydrocarbons having at least 5 carbon atoms. Examples of suitable PD pyrolysis oils include hydrocarbons having at least 5 carbon atoms in an amount of 90 wt. %, 95 wt. % wt. %, 98 wt. %, 99 wt. %, or greater. Additional examples of suitable PD pyrolysis oils include olefins in an amount of 50 wt. % or less. Additional examples of suitable PD pyrolysis oils include olefins in an amount of 0.1 wt. % to 50 wt. %, 0.1 wt. % to 40 wt. %, 0.1 wt. % to 25 wt. %, 0.1 wt. % to 10 wt. %, or 10 wt. % to 20 wt. %, 20 wt. % to 30 wt. %, 30 wt. % to 40 wt. %, or 30 wt. % to 50 wt. %, or any range therebetween. In some embodiments, the PD pyrolysis oil includes aromatics in an amount of 25 wt. % or less, including aromatics in an amount of 0.1 wt. % to 25 wt. %, 0.1 wt. % to 15 wt. %, 0.1 wt. % to 10 wt. %, or 10 wt. % to 20 wt. %, 20 wt. % to 25 wt. %, or any range therebetween. However, it should be understood that a PD pyrolysis oil can have concentrations of components outside these disclosed ranges.

Examples of suitable PD pyrolysis oil have properties suitable for a particular application. In some embodiments, the PD pyrolysis oil has an API gravity of 25 to 75, including an API gravity of 25 to 65, 25 to 50, 30 to 70, 50 to 75, or 30 to 65, or any range therebetween. In some embodiments, the PD pyrolysis oil has a final boiling point of 600° C. or less, including a final boiling point of 400° C. to 600° ° C., 450° C. to 600° C., 500° C. to 600° C., 550° C. to 600° C., 400° ° C. to 550° ° C., 450° ° C. to 550° ° C., 450° ° C. to 500° C., or 500° ° C. to 550° C., or any range therebetween. In some embodiments, the recycle pyrolysis oil has a kinematic viscosity at 40° C. ("KV40") of 2 cSt or less.

In some embodiments, the third co-feed includes a lubricant. The lubricant can be used in combination with the PD pyrolysis oil or in place of the PD pyrolysis oil. Lubricants include engine oil, crankcase lubricant, and various industrial lubricants. Lubricants in commercial use today are prepared, for example, from a variety of natural and synthetic base stocks admixed with various additive packages and solvents depending upon their intended application. The base stocks typically include mineral oils, polyalphaolefins (PAO), gas-to-liquid base oils (GTL), phosphate esters, diesters, polyol esters, and the like. In some embodiments, the lubricant includes a waste lubricant. Waste lubricants can also include non-hydrocarbon contaminants, which can make their processing challenging. These contaminants can be introduced during their use or can be lubricant additives. Examples of the contaminants include metals, sulfurs, and chlorides, among others.

A wide range of lubricating base stocks is known in the art. Lubricating base stocks are both natural oils and synthetic oils. Natural and synthetic oils (or mixtures thereof) can be used unrefined, refined, or re-refined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as feed stock.

Base stocks are categorized according to the American Petroleum Institute (API) classifications based on saturated hydrocarbon content, sulfur level, and viscosity index (see Table 1 infra). Typically, Group I, II, and III base stocks are each derived from crude oil via extensive processing, such as fractionating, solvent extraction, solvent dewaxing, and hydroisomerization. Group III base stocks can also be produced from synthetic hydrocarbon liquids obtained from natural gas, coal, or other fossil resources. Group IV base stocks include polyalphaolefins (PAOs), that are, for example, produced by the oligomerization of alpha olefins. Group V base stocks include all base stocks that do not belong to Groups I-IV, such as naphthenics, polyalkylene glycols (PAG), and esters. Additionally, there are the informal categories of base stocks referred to as "Group II+" and "Group III+" that are generally recognized within the lubricant industry as corresponding to base stocks that exceed the minimum classification requirements of the formal group. For example, a "Group II+" base stock may have a viscosity index (VI) above 110 and a "Group III+" base stock may have a viscosity index (VI) between 130 and 150.

Table 1 below summaries the properties of each of these five groups of base stocks.

TABLE 1

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | <0.03% and | ≥120 |
| Group IV | Polyalphaolefins (PAO) | | |
| Group V | All other base oil stocks not included in Groups I, II, III or IV | | |

The base stock constitutes the major component of the lubricant and typically is present in an amount ranging from 50 wt. % to 99 wt. %, including from 70 wt. % to 95 wt. % or from 85 wt. % to 95 wt. %. In some embodiments, the base stock has a kinematic viscosity at 100° C. (KV100), according to ASTM D445, of 2.5 cSt to 12 cSt and preferably of 2.5 cSt to 9 cSt. Mixtures of synthetic and natural base oils are used if desired. Bi-modal mixtures of Group I, II, III, IV, and/or V base stocks are also used if desired.

In addition to a base stocks, certain embodiments of the lubricant additionally contain one or more of commonly used lubricating oil performance additives, which include antioxidants, detergents, dispersants, antiwear agents, anti-scuffing agents, extreme pressure agents, anti-seizure agents, metal deactivators, corrosion inhibitors, friction modifiers, ionic liquids, pour point depressants, wax modifiers, viscosity modifiers, fluid-loss agents, fluidizing agents, seal compatibility agents, lubricity agents, antistatic agents, anti-staining agents, chromophoric agents, electrooptical agents, electroactive agents, electromagnetic agents, magnetically active agents, defoamants, demulsifiers, dehazing agents, emulsifiers, emulsifying aids, non-ionic surfactants, densifiers, wetting agents, gelling agents, tackifiers, colorants, dyes, odorants, odor masking agents, nano materials, nano-based agents, boron-containing agents, metal salts, nonmetal salts, and others, and mixtures thereof. Further, the performance additives, and additive components, discussed herein, may suitably be derived from natural, mineral, synthetic, bio-sourced, renewable, sustainable, conventional, or unconventional sources. Combinations of additives can also be used. These additives are commonly delivered with varying amounts of diluent oil, that range from 5 wt. % to 50 wt. %, for example.

Fluid Catalytic Cracking System

In one or more embodiments, the hydrocarbon feed including hydrocarbons is co-processed in an FCC system with a biomass feed of a BD pyrolysis oil and a waste feed of a PD pyrolysis oil and/or lubricant. FCC systems are commonly used in refineries as a method for converting feedstock to produce lower boiling fractions suitable for use as fuels. The process has become the pre-eminent source for motor gasoline in the USA and also serves the petrochemical industry with light olefins as petrochemical feedstock. Normal FCC operation cracks large molecules to a wide boiling mixture including olefins (alkenes).

The feeds are introduced into the FCC system and cracked into shorter molecules to produce cracked products. Examples of suitable cracked products include gasoline, diesel, distillate, olefins (e.g., ethylene, propylene, butylene, etc.), and other petroleum products. Typically, the FCC system includes a reactor for contacting the feeds with a fluidized FCC catalyst and a catalyst regenerator for regenerating the spent FCC catalyst for re-use. Conventional fluidized catalytic cracking units are suitable, but the invention is not limited thereto. The feeds including the hydrocarbon feed, biomass feed, and waste feed, can be cracked in the presence of one or more fluidized catalysts to produce a catalytically cracked effluent. The catalytically cracked effluent can be introduced to one or more separators and one, two, or more products can be separated therefrom. In some embodiments, one, two, or more of an FCC $C_{4-}$ product (a light hydrocarbon product), an FCC naphtha, an FCC cycle oil, and a bottoms product are recovered from the one or more separators. The FCC $C_{4-}$ product typically includes $C_1$, $C_2$, $C_3$, and $C_4$ hydrocarbon, and in addition generally one or more of molecular hydrogen, ammonia, carbon dioxide, arsine, mercury, hydrogen sulfide, carbonyl sulfide, mercaptans, and carbon disulfide, oxygenates or water. The FCC system can include additional equipment that is typically used in such a process, e.g., a separator such as a cyclone separator for separating the fluidized catalyst from the catalytically cracked effluent. It should also be understood that the FCC system can also include additional separators such as a catalyst fines separator configured to remove entrained catalyst particles from the bottoms product or other product(s) separated therefrom.

In at least one embodiment, the FCC system includes a riser reactor. In some embodiments, the riser reactor is an "internal" riser reactor or an "external" riser reactor, such as a vertical tube-shaped reactor, for example, which has a vertical upstream end located outside a reaction vessel and a vertical downstream end located inside the reaction vessel. Examples of suitable reaction vessels include a reaction vessel suitable for catalytic cracking reactions and/or a reaction vessel that includes one or more cyclone separators and/or swirl tubes to separate catalyst from cracked product.

Any number of reactors can be operated in series and/or in parallel. Any two or more types of reactors can be used in combination with one another. If two or more reactors are used the reactors can be operated at the same conditions and/or different conditions and can receive the same hydrocarbon-containing feed or different hydrocarbon-containing feeds. If two or more reactors are used the reactors can be arranged in series, in parallel, or a combination thereof with respect to one another. In some embodiments, suitable reactors can be or can include, but are not limited to, high gas velocity riser reactors, high gas velocity downer reactors, vortex reactors, reactors having a relatively dense fluidized catalyst bed at a first or bottom end and a relatively less dense fluidized catalyst within a riser located at a second or top end, multiple riser reactors and/or downer reactors operated in parallel and/or series operating at the same or different conditions with respect to one another, or combinations thereof.

In one or more embodiments, the hydrocarbon feed including hydrocarbons is co-fed to the reactor with a biomass feed of a BD pyrolysis oil and a waste feed of a plastic, a PD pyrolysis oil and/or lubricant. By co-feeding the hydrocarbons with the biomass and waste feeds, improved conversion to cracked products is provided. The first can be mixed with the second and third feeds before or after introduction into the reactor to yield a combined feed that is then cracked. In some embodiments, the first feed is supplied to the reactor a first location with the second and third feeds supplied to the reactor and second and third locations, respectively. In some embodiments, the biomass feed and/or waste feed are supplied to the reactor downstream of the hydrocarbon feed. In some embodiments, the biomass feed including the BD pyrolysis oil is fed to the reactor downstream of the first feed including the hydrocarbons. In some embodiments, a combined feed including a mixture of the hydrocarbon, biomass, and waste feeds is introduced to the reactor.

In one or more embodiments, the reactor is designed to have two or more feed injection nozzles. In some embodiments, the hydrocarbon feed including the hydrocarbons is introduced into the reactor through separate injection nozzles from the biomass feed and the waste feed with the biomass and waste feeds introduced through the same or different injection nozzles from one another. In some embodiments, the feeds are introduced into a riser with one or more feed injection nozzles. In one or more embodiments, the hydrocarbon feed including the hydrocarbons is introduced into the riser through separate injection nozzles from the biomass feed and the waste feed with the biomass and waste feeds introduced to the reactor through the same or different injection nozzles from one another. In some embodiments, the biomass and/or waste feeds are introduced to the riser downstream from the hydrocarbon feed.

The FCC catalyst can be any suitable catalyst for use in a cracking process. In at least one embodiment, the FCC catalyst includes any suitable zeolitic component for the FCC. Also, example embodiment of FCC catalyst further includes an amorphous binder compound and/or a filler. Examples of the amorphous binder component include quartz, zirconia, silica, alumina, magnesium oxide, calcium carbonate, and/or titania, and/or a mixture thereof of at least two or more of these components. Examples of suitable fillers include clays (such as hydrated aluminum silicate, also called "kaolin") and/or silica. For purpose of the present disclosure, the zeolitic component can be a large, a medium, and/or a mixture thereof of large and medium pore zeolite which include a porous, crystalline aluminosilicate structure, for example In some embodiments, the FCC catalyst can be pneumatically moved through the reactor via a carrier fluid or transport fluid. The transport fluid can be or can include, but is not limited to, a diluent, one or more of the feeds in gaseous form, or a mixture thereof. Examples of suitable transport fluids include molecular nitrogen, volatile hydrocarbons such methane, ethane, and/or propane, argon, carbon monoxide, carbon dioxide, steam, and the like. The amount of transport fluid can be sufficient to maintain the catalyst in a fluidized state and to transport the catalyst particles from one location, e.g., the combustion zone or the regeneration zone, to a second location, e.g., the conversion zone. In some embodiments, a weight ratio of the catalyst to the transport fluid can be in a range from 5, 10, 15, or 20 to 50, 60, 80, 90, or 100.

The feeds and FCC catalyst can be contacted in the reactor at a reactor operating temperature in a range from 300° C. to 900° C., including from 300° C. to 800° C., from 300° C. to 700° C., 300° C. to 600° C., 300° C. to 500° C., 300° C. to 400° C., 400° C. to 900° C., 400° C. to 800° C., 400° C. to 700° C., 400° C. to 600° C., 500° C. to 900° C., 500° C. to 800° C., or 500° C. to 700° C., or any range therebetween. The feeds can be introduced into the reactor and contacted with the FCC catalyst therein for a time period in a range from 0.1 seconds to 3 minutes, including from 1 second to 3 minutes, from 1 second to 2 minutes, from 1 second to 1 minute, from 1 second to 30 seconds, from 30 seconds to 3 minutes, from 30 seconds to 2 minutes, or from 30 seconds to 1 minute, or any range therebetween.

The average residence time of the FCC catalyst within the conversion zone can be ≤7 minutes, ≤6 minutes, ≤5 minutes, ≤4 minutes ≤3 minutes, ≤2 minutes, ≤1.5 minutes, ≤1 minute, ≤45 seconds, ≤30 seconds, ≤20 seconds, ≤15 seconds, ≤10 seconds, ≤7 seconds, ≤5 seconds, ≤3 seconds, ≤2 seconds, or ≤1 second. In some embodiments, the average residence time of the FCC catalyst within the conversion zone can be greater than an average residence time of the feeds.

The feeds and FCC catalyst can be contacted under a hydrocarbon partial pressure of at least 20 kPa-absolute, where the hydrocarbon partial pressure is the total partial pressure of any $C_2$-$C_{16}$ alkanes and any $C_8$-$C_{16}$ alkyl aromatic hydrocarbons in the feeds. In some embodiments, the hydrocarbon partial pressure during contact of the feeds and the FCC catalyst is in a range from 20 kPa-absolute to 1,000 kPa-absolute, including from 20 kPa-absolute to 750 kPa-absolute, from 20 kPa-absolute to 500 kPa-absolute, from 20 kPa-absolute to 200 kPa-absolute, from 20 kPa-absolute to 100 kPa-absolute, from 50 kPa-absolute to 1,000 kPa-absolute, from 100 kPa-absolute to 1,000 kPa-absolute, from 200 kPa-absolute to 1,000 kPa-absolute, from 500 kPa-absolute to 1,000 kPa-absolute, or from 750 kPa-absolute to 1,000 kPa-absolute, or any range therebetween, where the hydrocarbon partial pressure is the total partial pressure of any $C_2$-$C_{16}$ alkanes and any $C_8$-$C_{16}$ alkyl aromatic hydrocarbons in the total feed of the hydrocarbon feed, biomass feed, and waste feed.

In at least one embodiment, cracked products produced in the reactor are separated from spent (deactivated) FCC catalyst. Example embodiments include a catalyst regenerator for regenerating the spent FCC catalyst for re-use. The regenerated FCC catalyst is then recycled to the reactor in accordance with present embodiments. In at least one embodiment, a side stream of make-up FCC catalyst is added to the recycle stream to make-up for loss of FCC catalyst in the reaction zone and regenerator.

Separation of the spent FCC catalyst from the cracked products uses any suitable technique. In some embodiments, the separation includes separating one or more of the cracked products from the spent FCC catalyst using one or more cyclone separators and/or one or more swirl tubes. Furthermore, example embodiments include a stripping process such as the spent FCC catalyst is stripped to recover the cracked products absorbed on the spent FCC catalyst before catalyst regeneration. In some embodiments, the recovered products are recycled and added to a stream including one or more cracked products obtained from the catalytic cracking process.

In at least one embodiment, catalyst regeneration includes contacting the spent FCC catalyst with an oxygen-containing gas in the catalyst regenerator, in order to produce a regenerated FCC catalyst, heat, and carbon dioxide. The catalyst activity can be restored during the regeneration where the coke that can be deposited on the FCC catalyst, as a result of the reactions in the reactor, is burned off. Examples of suitable oxygen-containing gases include any suitable oxygen containing gas, such as air or oxygen-enriched air (OEA).

FIG. 1 illustrates an FCC system 10 in accordance with one or more embodiments. The FCC system 10 includes a reactor 12 in the form a riser reactor that includes a reaction vessel 14 and a riser 16 coupled to the reaction vessel 14. The reactor 12 contains an FCC catalyst (not shown). As illustrated, a combined feed 18 is fed to the riser 16 of the reactor 12 at a first location 20 where it is vaporized and cracked into smaller molecules by contact and mixing with the FCC catalyst, for example. The combined feed 18 includes the hydrocarbon feed of the hydrocarbons, the biomass feed of the BD pyrolysis oil and the waste feed of the plastic, PD pyrolysis oil, and/or lubricant. An FCC effluent 22 including cracked products is withdrawn from the reaction vessel 14. While not shown, the FCC effluent 22 is further processed, for example, separated to form various products, such as an FCC $C_{4-}$ product (a light hydrocarbon product), an FCC naphtha, an FCC cycle oil, and/or a bottoms product. The reaction in the reactor 12 also produces a carbonaceous material (e.g., coke) that deposits on the FCC catalyst causing it to lose effectiveness. In order to maintain effectiveness of the FCC catalyst, the spent FCC catalyst must be regenerated. As illustrated, the spent FCC catalyst is fed to a catalyst regenerator 24 via spent catalyst line 26, for example, to remove the coke. As illustrated, the reactor 12 and the catalyst regenerator 24 can be separate vessels. An oxygen-containing gas can be feed to the catalyst regenerator 24. After regeneration, the regenerated FCC catalyst is then fed back to the reactor 10, for example, to the riser 16 via regenerated catalyst line 28

Figure 2:
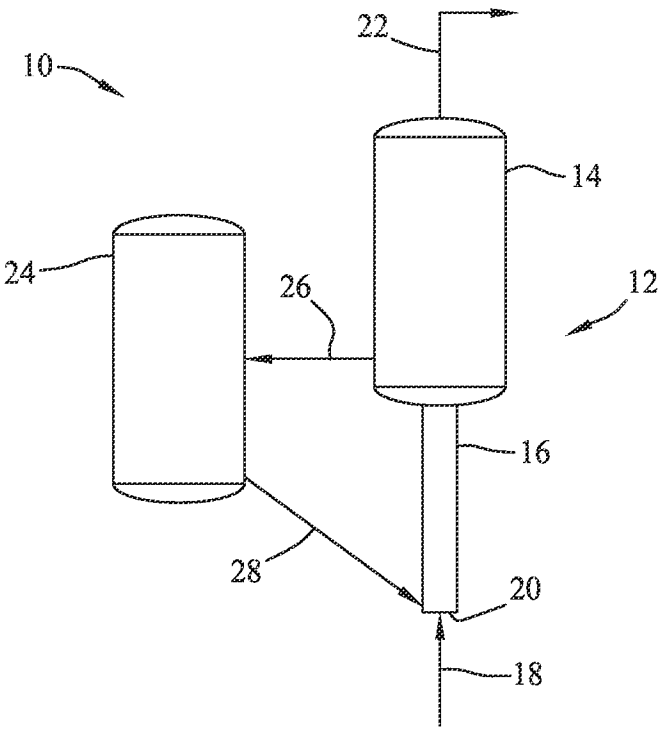
FIG. 2 is an illustrative depiction of the FCC system of FIG. 1 with an alternative feed arrangement in accordance with certain embodiments of the present disclosure.

FIG. 2 illustrates an FCC system 10 with a different feed arrangement in accordance with one or more embodiments. The FCC system 10 includes the reactor 12 with a reaction vessel 14 and a riser 16. The reactor 12 contains an FCC catalyst. As illustrated, a feed to the riser 16 of the reactor 12 is vaporized and cracked into smaller molecules by contact and mixing with the FCC catalyst, for example. The feed includes a hydrocarbon feed 30 of the hydrocarbons, a biomass feed 32 of the BD pyrolysis oil, and the waste feed 34 of the plastic, PD pyrolysis oil and/or lubricant. In the illustrated embodiment, the hydrocarbon feed 30, biomass feed 32, and waste feed 34 are not pre-mixed prior to their introduction into the riser 16 but are rather separately feed into the riser 16. The FCC effluent 22 including cracked products is withdrawn from the reaction vessel 14. As illustrated, the spend FCC catalyst is fed to a catalyst regenerator 24 via spent catalyst line 26, for example, to remove the coke. After regeneration, the regenerated FCC catalyst is then fed back to the reactor 10, for example, to the riser 16 via regenerated catalyst line 28.

Figure 3:
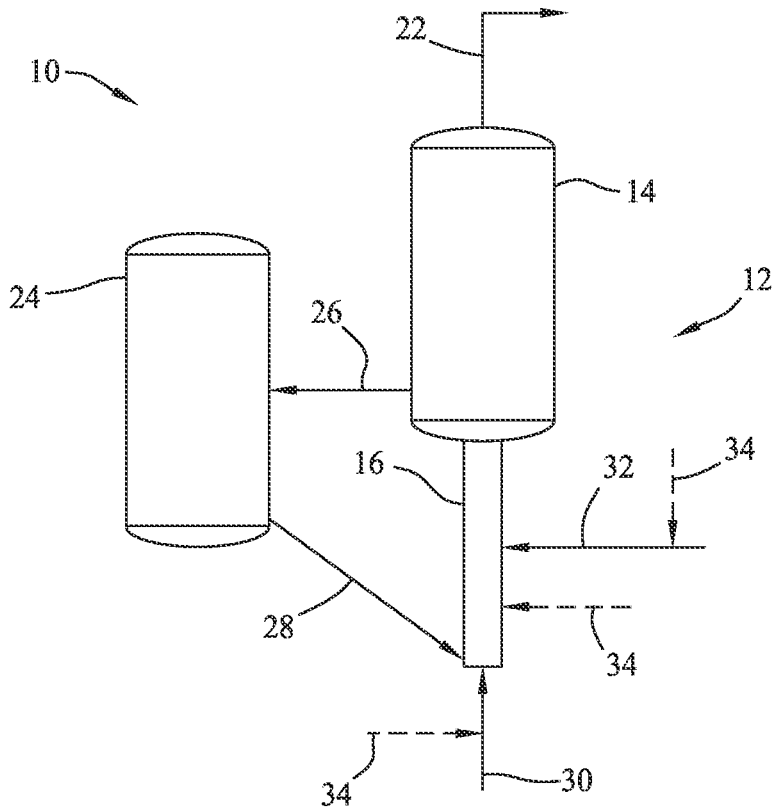
FIG. 3 is an illustrative depiction of an FCC system for processing a hydrocarbon feed with one or more alternative feedstocks in accordance with certain embodiments of the present disclosure.

FIG. 3 illustrates an FCC system 10 with a different feed arrangement in accordance with one or more embodiments. The FCC system 10 includes the reactor 12 with a reaction vessel 14 and a riser 16. The reactor 12 contains an FCC catalyst. As illustrated, a feed to the riser 16 of the reactor 12 is vaporized and cracked into smaller molecules by contact and mixing with the FCC catalyst, for example. The feed includes a hydrocarbon feed 30 of the hydrocarbons, a biomass feed 32 of the BD pyrolysis oil, and the waste feed 34 of the plastic, PD pyrolysis oil, and/or lubricant. In the illustrated embodiment, the biomass feed 32 is introduced into the riser 16 downstream of the hydrocarbon feed 30. As illustrated, the waste feed 34 is pre-mixed with one or both of the hydrocarbon feed 30 or the biomass feed 32 prior to introduction into the riser 16 and/or the waste feed 34 is separately introduced into the riser 16. The FCC effluent 22 including cracked products is withdrawn from the reaction vessel 14. As illustrated, the spend FCC catalyst is fed to a catalyst regenerator 24 via spent catalyst line 26, for example, to remove the coke. After regeneration, the regenerated FCC catalyst is then fed back to the reactor 10, for example, to the riser 16 via regenerated catalyst line 28.

ADDITIONAL EMBODIMENTS

Accordingly, the present disclosure provides methods and systems for co-processing a hydrocarbon feed in an FCC system with a biomass feed of a BD pyrolysis oil and a waste feed of a PD pyrolysis oil and/or lubricant. The methods and systems may include any of the various features disclosed herein, including one or more of the following statements.

Embodiment 1. A method of co-processing fluid catalytic cracking feeds, comprising: introducing a hydrocarbon feed to a fluid catalytic cracking reactor, wherein the hydrocarbon feed comprises hydrocarbons; introducing a biomass feed to the fluid catalytic cracking reactor wherein the biomass feed comprises a biomass-derived pyrolysis oil; introducing a waste feed to the fluid catalytic cracking reactor, wherein the waste feed comprises a plastic, a plastic-derived pyrolysis oil, a lubricant, or a combination thereof; and reacting at least the hydrocarbon feed, the biomass feed, and the waste feed in the presence of one or more fluid catalytic cracking catalysts in the fluid catalytic cracking reactor to produce cracked products.

Embodiment 2. The method of Embodiment 1, wherein hydrocarbon feed comprises a petroleum crude, an atmospheric residue, a vacuum residue, propane deasphalted residue, fluid catalytic tower bottoms, an atmospheric gas oil, a vacuum gas oil, a coker gas oil, a distillate, a hydrocrackate, a hydrotreated oil, a dewaxed oil, a slack wax, a Fischer-Tropsch wax, a raffinate, or combinations thereof.

Embodiment 3. The method of Embodiment 1 or Embodiment 2, wherein the bio-mass derived pyrolysis oil is derived from a lignocellulosic biomass, a cellulose, a hemicellulose, a polysaccharide, a pectin, a lignin, a chitin, a protein, algae, or combination thereof.

Embodiment 4. The method of any preceding Embodiment, wherein the waste feed comprises the lubricant.

Embodiment 5. The method of any preceding Embodiment, wherein the waste feed comprises the plastic-derived pyrolysis oil.

Embodiment 6. The method of any preceding Embodiment, wherein the waste feed comprises the plastic.

Embodiment 7. The method of any preceding Embodiment, wherein the waste feed has a hydrogen-to-carbon ratio of 1.9 or more.

Embodiment 8. The method of any preceding Embodiment, wherein the hydrocarbon feed comprises vacuum gas oil that comprises the hydrocarbons, wherein the bio-mass derived pyrolysis oil is derived from a wood biomass, and wherein the waste feed comprises the lubricant.

Embodiment 9. The method of Embodiment 8, wherein the fluid catalyst cracking catalyst comprise a zeolitic component.

Embodiment 10. The method of Embodiment 8, wherein the lubricant comprises a polyalphaolefin base stock.

Embodiment 11. The method of any preceding Embodiment, wherein the hydrocarbon feed, the biomass feed, and the waste feed are separately introduced to a riser of the fluid catalytic cracking reactor.

Embodiment 12. The method of any preceding Embodiment, wherein the biomass feed is introduced to a riser downstream of the hydrocarbon feed.

Embodiment 13. The method of any preceding Embodiment, wherein the hydrocarbon feed is introduced into a riser the fluid catalytic cracking reactor through separate injection nozzles from the biomass feed and the waste feed.

Embodiment 14. The method of any preceding Embodiment, further comprising flowing a spent fluid catalytic cracking catalyst to a catalyst regenerate for coke removal, wherein regenerated catalyst is flowed back to the fluid catalyst cracking reactor.

Embodiment 15. The method of any preceding Embodiment, wherein product conversion in the fluid catalytic cracking reactor is increased by about 1% to about 20% on a hydrocarbon basis as compared to feeding the first feed along to the fluid catalytic cracking reactor at the same reactor severity.

Embodiment 16. A system for cracking hydrocarbons, comprising: a first source of a hydrocarbon feed comprising hydrocarbons; a second source of a biomass feed comprising a biomass-derived pyrolysis oil; a third source of a waste feed comprising a plastic, a plastic-derived pyrolysis oil, a lubricant, or a combination thereof; and a fluid catalytic cracking system comprising a fluid catalytic cracking reactor and a catalyst regenerator, wherein the fluid catalytic cracking reactor is fluidically coupled to the catalyst regenerator such the fluid catalytic cracking reactor receives regenerated catalyst from the catalyst regenerator, wherein the fluid catalytic cracking reactor is fluidically coupled to the first source of the hydrocarbon feed; wherein the fluid catalytic cracking reactor is fluidically coupled to the second source of the biomass feed; and wherein the fluid catalytic cracking reactor is fluidically coupled to the third source of the waste feed.

Embodiment 17. The system of Embodiment 16, wherein hydrocarbon feed comprises a petroleum crude, an atmospheric residue, a vacuum residue, propane deasphalted residue, fluid catalytic tower bottoms, an atmospheric gas oil, a vacuum gas oil, a coker gas oil, a distillate, a hydrocrackate, a hydrotreated oil, a dewaxed oil, a slack wax, a Fischer-Tropsch wax, a raffinate, or combinations thereof.

Embodiment 18. The method of Embodiment 16 or Embodiment 17, wherein the first feed comprises vacuum gas oil that comprises the hydrocarbons, wherein the bio-mass derived pyrolysis oil is derived from a wood biomass, and wherein the third feed comprises the lubricant.

Embodiment 19. The method of any one of Embodiments 16 to 18, wherein the second source is fluidically coupled to the fluid catalytic cracking reactor downstream from the first source.

Embodiment 20. The method of any one of Embodiments 16 to 19, wherein the reactor comprises a fluid catalytic cracking catalyst comprising a zeolitic component.

To facilitate a better understanding of the present invention, the following examples of certain aspects of some embodiments are given. In no way should the following examples be read to limit, or define, the entire scope of the disclosure.

EXAMPLES

A series of tests were conducted to evaluate coprocessing a vacuum gas oil in a laboratory-scale FCC reactor. The FCC reactor was an ACE Model R from Kayser Technology, Inc. The catalyst used in the FCC reactor was E-Cat, which is used commercially at refineries. Tests were conducted at 870° C. and 970° C. with a 1.04 psig max reactor pressure, 0.91 g/min feed flow rate, and a feed injection time of 84 seconds. Four feeds to the FCC reactor were tested at each temperature:

1. Feed 1 (Comparative): Vacuum Gas Oil (VGO) Only
2. Feed 2 (Comparative): VGO with 10 wt. % BD Fast Pyrolysis Oil (i.e., 90% VGO+10% BD Fast Pyrolysis Oil)
3. Feed 3 (Comparative): VGO with 10 wt. % Lubricant of a Polyalphaolefin (PAO) Base Stock (i.e., 90% VGO+10% Lubricant)
4. Feed 4: VGO with 10 wt. % BD Fast Pyrolysis Oil and 10 wt. % Lubricant of a PAO Base Stock (i.e., 80% VGO+10% BD Fast Pyrolysis Oil+10% Lubricant)

Figure 4:
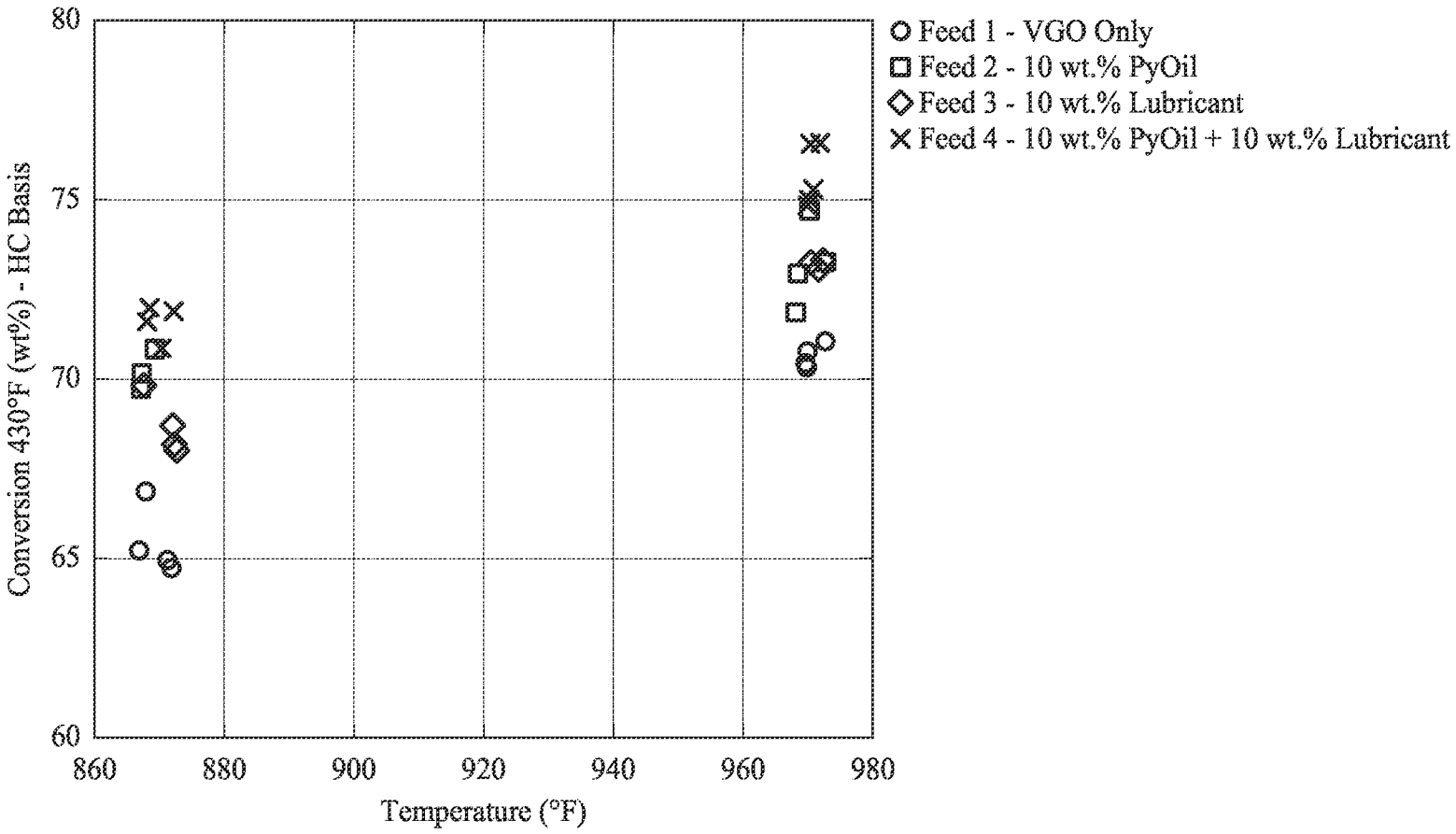
FIG. 4 is a graph showing conversion percent for various feeds to a laboratory scale FCC system, in accordance with certain embodiments of the present disclosure.
Figure 5:
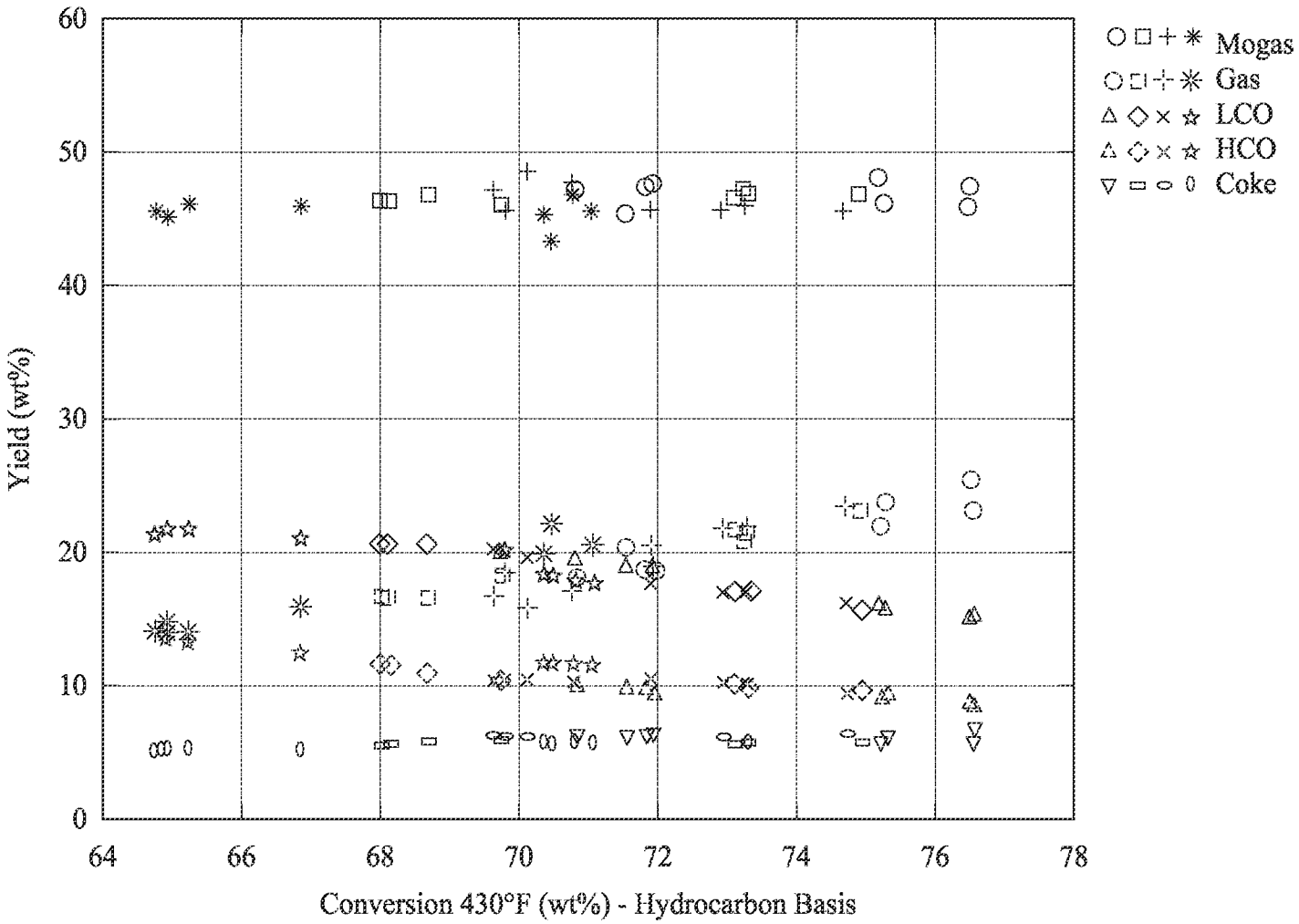
FIG. 5 is a graph showing yield for various feeds to a laboratory scale FCC fluid catalyst cracking system, in accordance with certain embodiments of the present disclosure.

The test data was analyzed to determine conversion and product yield. FIG. 4 is a chart showing conversion as a function of temperature. As illustrated, co-feeding the BD fast pyrolysis oil or lubricant has a positive effect by having increased conversion at the same reactor. Even further, there is a synergistic effect where co-feeding all three materials to the reactor has the highest conversion. On FIG. 4, the conversion is listed as a 430° F. (221° C.) conversion, indicating the weight percentage of the product that boils below this temperature. FIG. 5 is a chart showing yield of various products as a function of conversion. The products shown are motor gas (Mogas), olefins (Gas), light cycle oil (LCO), heavy cycle oil (HCO), and coke. As illustrate, the co-feeds are compatible with one another as they produced similar yields of the various products as Feeds 1, 2, and 3.

While the disclosure has been described with respect to a number of embodiments and examples, those skilled in the art, having benefit of this disclosure, will appreciate that other embodiments can be devised which do not depart from the scope and spirit of the disclosure as disclosed herein. Although individual embodiments are discussed, the present disclosure covers all combinations of all those embodiments.

While compositions, methods, and processes are described herein in terms of "comprising," "containing," "having," or "including" various components or steps, the compositions and methods can also "consist essentially of" or "consist of" the various components and steps. The phrases, unless otherwise specified, "consists essentially of"

and "consisting essentially of" do not exclude the presence of other steps, elements, or materials, whether or not, specifically mentioned in this specification, so long as such steps, elements, or materials, do not affect the basic and novel characteristics of the disclosure, additionally, they do not exclude impurities and variances normally associated with the elements and materials used.

All numerical values within the detailed description are modified by "about" the indicated value, and take into account experimental error and variations that would be expected by a person having ordinary skill in the art.

Many alterations, modifications, and variations will be apparent to those skilled in the art in light of the foregoing description without departing from the spirit or scope of the present disclosure and that when numerical lower limits and numerical upper limits are listed herein, ranges from any lower limit to any upper limit are contemplated.

The invention claimed is:

1. A method of co-processing fluid catalytic cracking feeds, comprising:

introducing a hydrocarbon feed to a fluid catalytic cracking reactor, wherein the hydrocarbon feed comprises hydrocarbons;

introducing a biomass feed to the fluid catalytic cracking reactor wherein the biomass feed comprises a biomass-derived pyrolysis oil;

introducing a waste feed to the fluid catalytic cracking reactor, wherein the waste feed comprises a lubricant; and reacting at least the hydrocarbon feed, the biomass feed, and the waste feed in the presence of one or more fluid catalytic cracking catalysts in the fluid catalytic cracking reactor to produce cracked products.

2. The method of claim 1, wherein hydrocarbon feed comprises a petroleum crude, an atmospheric residue, a vacuum residue, propane deasphalted residue, fluid catalytic tower bottoms, an atmospheric gas oil, a vacuum gas oil, a coker gas oil, a distillate, a hydrocrackate, a hydrotreated oil, a dewaxed oil, a slack wax, a Fischer-Tropsch wax, a raffinate, or combinations thereof.

3. The method of claim 1, wherein the biomass-derived pyrolysis oil is derived from a lignocellulosic biomass, a cellulose, a hemicellulose, a polysaccharide, a pectin, a lignin, a chitin, a protein, algae, or combination thereof.

4. The method of claim 1, wherein the waste feed comprises a plastic-derived pyrolysis oil.

5. The method of claim 1, wherein the waste feed comprises the plastic.

6. The method of claim 1, wherein the waste feed has a hydrogen-to-carbon ratio of 1.9 or more.

7. The method of claim 1, wherein the hydrocarbon feed comprises vacuum gas oil that comprises the hydrocarbons, wherein the biomass-derived pyrolysis oil is derived from a wood biomass.

8. The method of claim 7, wherein the fluid catalyst cracking catalyst comprise a zeolitic component.

9. The method of claim 7, wherein the lubricant comprises a polyalphaolefin base stock.

10. The method of claim 1, wherein the hydrocarbon feed, the biomass feed, and the waste feed are separately introduced to a riser of the fluid catalytic cracking reactor.

11. The method of claim 1, wherein the biomass feed is introduced to a riser downstream of the hydrocarbon feed.

12. The method of claim 1, wherein the hydrocarbon feed is introduced into a riser the fluid catalytic cracking reactor through separate injection nozzles from the biomass feed and the waste feed.

13. The method of claim 1, further comprising flowing a spent fluid catalytic cracking catalyst to a catalyst regenerator for coke removal, wherein regenerated catalyst is flowed back to the fluid catalyst cracking reactor.

14. The method of claim 1, wherein product conversion in the fluid catalytic cracking reactor is increased by about 1% to about 20% on a hydrocarbon basis when feeding the hydrocarbon feed, the biomass feed, and the waste feed as compared to feeding the hydrocarbon feed alone to the fluid catalytic cracking reactor at the same reactor severity.

15. A system for cracking hydrocarbons, comprising:

a first source of a hydrocarbon feed comprising hydrocarbons;

a second source of a biomass feed comprising a biomass-derived pyrolysis oil;

a third source of a waste feed comprising a lubricant; and a fluid catalytic cracking system comprising a fluid catalytic cracking reactor and a catalyst regenerator, wherein the fluid catalytic cracking reactor is fluidically coupled to the catalyst regenerator such the fluid catalytic cracking reactor receives regenerated one or more fluid catalytic cracking catalysts from the catalyst regenerator, wherein the fluid catalytic cracking reactor is fluidically coupled to the first source of the hydrocarbon feed;

wherein the fluid catalytic cracking reactor is fluidically coupled to the second source of the biomass feed;

wherein the fluid catalytic cracking reactor is fluidically coupled to the third source of the waste feed; and wherein the fluid catalytic cracking reactor is configured to receive co-feeds of the hydrocarbon feed, the biomass feed, and the waste feed, and to react the hydrocarbon feed, the biomass feed, and the waste feed in the presence of one or more fluid catalytic cracking catalysts to produce cracked products.

16. The system of claim 15, wherein hydrocarbon feed comprises a petroleum crude, an atmospheric residue, a vacuum residue, propane deasphalted residue, fluid catalytic tower bottoms, an atmospheric gas oil, a vacuum gas oil, a coker gas oil, a distillate, a hydrocrackate, a hydrotreated oil, a dewaxed oil, a slack wax, a Fischer-Tropsch wax, a raffinate, or combinations thereof.

17. The method of claim 15, wherein the first feed comprises vacuum gas oil that comprises the hydrocarbons, wherein the bio-mass derived pyrolysis oil is derived from a wood biomass, and wherein the third feed comprises the lubricant.

18. The method of claim 15, wherein the second source is fluidically coupled to the fluid catalytic cracking reactor downstream from the first source.

19. The method of claim 15, wherein the reactor comprises a fluid catalytic cracking catalyst comprising a zeolitic component.

* * * * *